US009540894B2

(12) United States Patent
June et al.

(10) Patent No.: US 9,540,894 B2
(45) Date of Patent: Jan. 10, 2017

(54) TUBING HANGER RUNNING TOOL WITH INTEGRATED LANDING FEATURES

(71) Applicant: Cameron International Corporation, Houston, TX (US)

(72) Inventors: David June, Houston, TX (US); Claudio Santilli, Houston, TX (US)

(73) Assignee: OneSubsea IP UK Limited, London (GB)

( * ) Notice: Subject to any disclaimer, the term of this patent is extended or adjusted under 35 U.S.C. 154(b) by 530 days.

(21) Appl. No.: 13/975,253

(22) Filed: Aug. 23, 2013

(65) Prior Publication Data

US 2014/0069633 A1 Mar. 13, 2014

Related U.S. Application Data

(63) Continuation of application No. 12/757,348, filed on Apr. 9, 2010, now Pat. No. 8,567,493.

(51) Int. Cl.

| | |
|---|---|
| ***E21B 23/10*** | (2006.01) |
| ***E21B 23/00*** | (2006.01) |
| ***E21B 33/035*** | (2006.01) |
| ***E21B 33/043*** | (2006.01) |

(52) U.S. Cl.

CPC ..... *E21B 23/10* (2013.01); *E21B 23/00* (2013.01); *E21B 33/0355* (2013.01); *E21B 33/043* (2013.01)

(58) Field of Classification Search

CPC ..... E21B 23/00; E21B 23/10; E21B 34/101; E21B 33/0355; E21B 33/043

See application file for complete search history.

(56) References Cited

U.S. PATENT DOCUMENTS

| | | | | |
|---|---|---|---|---|
| 3,494,417 | A | 2/1970 | Fredd | |
| 4,386,656 | A | 6/1983 | Fisher et al. | |
| 4,474,236 | A | 10/1984 | Kellett | |
| 4,736,799 | A | 4/1988 | Ahlstone | |
| 4,880,061 | A | 11/1989 | Ahlstone | |
| 5,415,237 | A * | 5/1995 | Strattan | E21B 34/10 166/324 |
| 6,082,460 | A | 7/2000 | June | |

(Continued)

FOREIGN PATENT DOCUMENTS

| | | |
|---|---|---|
| WO | 2009070400 | 6/2009 |
| WO | 2011126591 | 10/2011 |

OTHER PUBLICATIONS

PCT International Search Report and Written Opinion for PCT Application No. PCT/US2011/022641 mailed Mar. 9, 2012.

(Continued)

*Primary Examiner* — Yong-Suk (Philip) Ro
(74) *Attorney, Agent, or Firm* — Fletcher Yoder PC

(57) ABSTRACT

A system, in certain embodiments, includes a tubing hanger running tool (THRT) configured to position a tubing hanger within a wellhead. The THRT includes an integrated pressure equalization system including a tube having a first end in fluid communication with an annulus of the wellhead, and a second end in fluid communication with a control line. The integrated pressure equalization system also includes a piston disposed within the tube. The piston is configured to move within the tube to balance a pressure differential between a first fluid within the annulus and a second fluid within the control line.

20 Claims, 12 Drawing Sheets

(56) References Cited

U.S. PATENT DOCUMENTS

| | | | | |
|---|---|---|---|---|
| 6,488,083 | B2 | 12/2002 | Bartlett et al. | |
| 6,497,277 | B2 | 12/2002 | Cunningham et al. | |
| 6,520,263 | B2 | 2/2003 | June | |
| 6,598,680 | B2 | 7/2003 | DeBerry | |
| 6,659,181 | B2 | 12/2003 | Hartman | |
| 7,350,580 | B1 | 4/2008 | Laureano | |
| 7,419,001 | B2 | 9/2008 | Broussard | |
| 7,513,308 | B2 | 4/2009 | Hoise et al. | |
| 2001/0042618 | A1 | 11/2001 | Cunningham et al. | |
| 2001/0054507 | A1 | 12/2001 | Bartlett et al. | |
| 2003/0019531 | A1 | 1/2003 | Satoh | |
| 2003/0019631 | A1 | 1/2003 | DeBerry | |
| 2003/0089501 | A1 | 5/2003 | Hartmann | |
| 2004/0074636 | A1 | 4/2004 | Bartlett et al. | |
| 2006/0042799 | A1 | 3/2006 | Hosie et al. | |
| 2006/0260799 | A1 | 11/2006 | Broussard | |
| 2008/0078555 | A1 | 4/2008 | Young et al. | |
| 2009/0188662 | A1* | 7/2009 | Casciaro ..... | E21B 34/10 166/53 |
| 2009/0211761 | A1 | 8/2009 | Broussard | |
| 2010/0229981 | A1 | 9/2010 | June | |
| 2011/0247798 | A1 | 10/2011 | June et al. | |

OTHER PUBLICATIONS

PCT International Search Report and Written Opinion for PCT Application No. PCT/US2011/022645 mailed Feb. 28, 2012.
Singapore Examination Report and Written Opinion for Singapore Application No. 201207016-5 dated Apr. 15, 2013.

* cited by examiner

TUBING HANGER RUNNING TOOL WITH INTEGRATED LANDING FEATURES

CROSS REFERENCE TO RELATED APPLICATION

This application claims priority to and benefit of U.S. Non-Provisional patent application Ser. No. 12/757,348, Entitled "Tubing Hanger Running Tool With Integrated Landing Features", Filed on Apr. 9, 2010, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

In some drilling and production systems, hangers, such as a tubing hanger, may be used to suspend strings (e.g., piping for various flows in and out of the well) of the well. Such hangers may be disposed within a spool of a wellhead which supports both the hanger and the string. For example, a tubing hanger may be lowered into a tubing spool by a drilling string. During the running or lowering process, the tubing hanger may be latched to a tubing hanger running tool (THRT), thereby coupling the tubing hanger to the drilling string. Once the tubing hanger has been lowered into a landed position within the tubing spool, the tubing hanger may be permanently locked into position. The THRT may then be unlatched from the tubing hanger and extracted from the wellhead by the drilling string.

In certain configurations, the processes of locking the tubing hanger to the tubing spool, unlatching the THRT from the tubing hanger, and/or other operations associated with running the tubing hanger may be performed by hydraulic actuators located within the THRT. In subsea operations, such actuators may be operated by hydraulic lines which extend from the THRT to a surface vessel or platform via an umbilical line. Unfortunately, due to the length of the umbilical line, deployment may be a costly and time consuming processing. In addition, the umbilical line may consume large amounts of space on the deck of the vessel or platform which could be utilized for other equipment.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
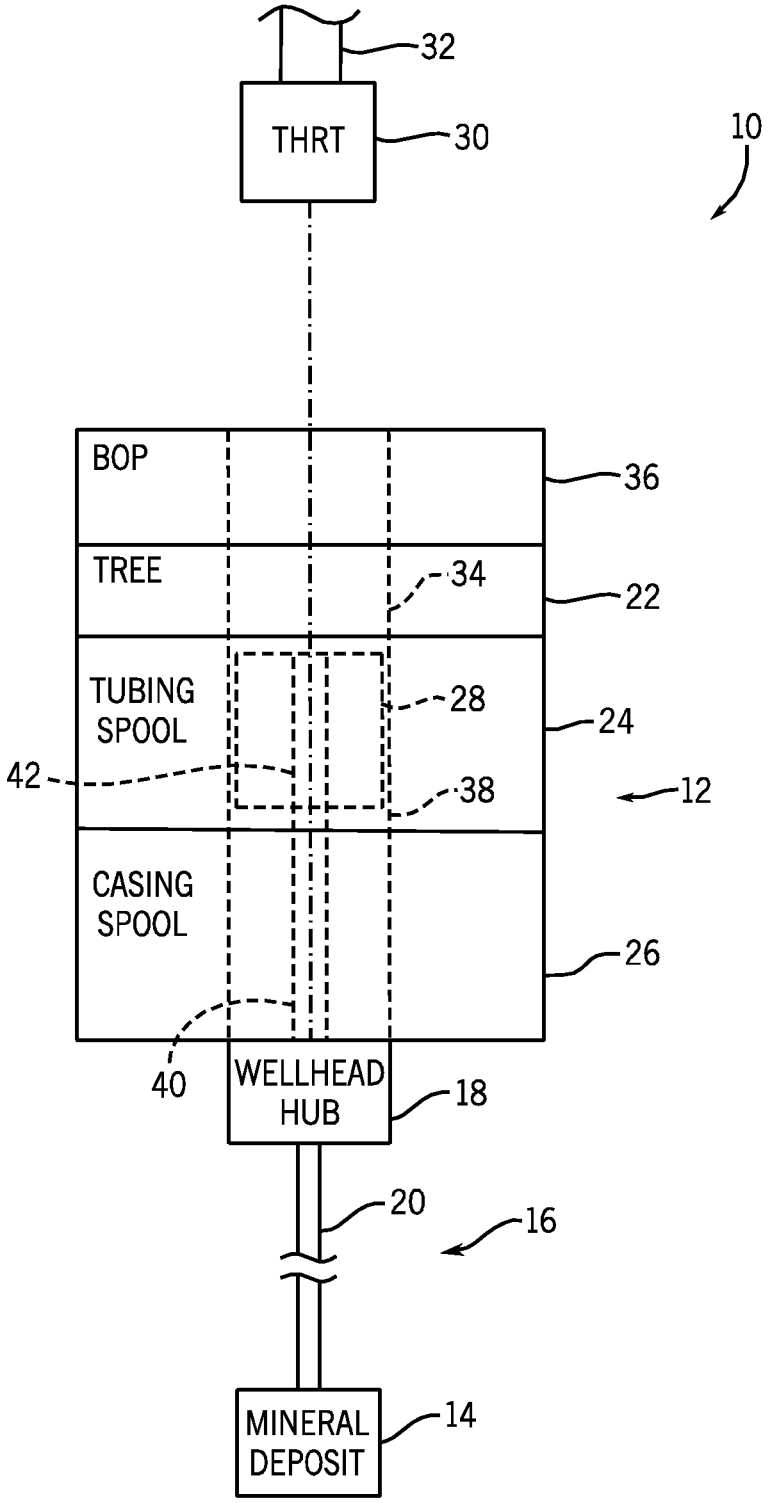
FIG. 1 is a block diagram that illustrates a mineral extraction system in accordance with certain embodiments of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure may obviate an umbilical line extending between a tubing hanger running tool (THRT) and a surface vessel or platform by providing a THRT including unique features configured to facilitate running a tubing hanger without separate hydraulic connections to the surface vessel or platform. For example, as discussed in detail below, it may be desirable to run the tubing hanger with a subsurface safety valve (SSV) in an open position. Typical SSVs are biased toward a closed position, and configured to open by application of hydraulic pressure. Consequently, certain THRT configurations include a hydraulic line extending from the surface vessel to the SSV to hold the SSV in the open position during the running process, and to close the SSV once landed within the wellhead. In contrast, the present embodiments employ a pressure release valve configured to hold the SSV in the open position during the running process. Specifically, the THRT includes a pressure release valve in fluid communication with the SSV. The pressure release valve is biased toward a closed position that blocks fluid flow from the SSV such that sufficient hydraulic pressure is maintained within the SSV to hold the SSV in the open position. Furthermore, contact between the pressure release valve and a wellhead drives the pressure release valve toward an open position that facilitates fluid flow from the SSV such that sufficient hydraulic pressure is released from the SSV to close the SSV. Therefore, the present embodiments obviate the separate hydraulic line which may extend to the surface vessel or platform to control operation of the SSV during the running process.

In addition, certain THRT configurations employ a soft landing system configured to gradually lower the tubing hanger into a tubing spool. Such configurations may utilize a hydraulic line extending from the THRT to the surface vessel to drain hydraulic fluid from a chamber within the THRT, thereby lowering the tubing hanger into position. Certain embodiments of the present disclosure may provide a THRT having an integrated and self-contained soft landing system. For example, in certain embodiments, the THRT includes an annular chamber disposed between an outer casing of the THRT and a body of the THRT. The annular chamber is configured to contain sufficient hydraulic fluid to suspend the body relative to the outer casing. The THRT may also include a valve in fluid communication with the annular chamber and an annulus of the wellhead, and a release mechanism coupled to the valve. In such a configuration, activation of the release mechanism opens the valve to facilitate flow of hydraulic fluid from the annular chamber to the annulus of the wellhead, thereby lowering the tubing hanger into the tubing spool. Consequently, the hydraulic line which may extend to the surface vessel to control operation of the soft landing system may be obviated.

Furthermore, certain THRT configurations employ fluidic connections between control lines which extend down a well bore and conduits which extend to the surface vessel. In such configurations, the surface vessel may maintain a desired pressure within the control lines during the running process. In contrast, certain embodiments of the present disclosure employ a THRT that includes an integrated pressure equalization system which automatically maintains a suitable pressure within the control lines. For example, in certain embodiments, the THRT includes a tube having a first end in fluid communication with an annulus of the wellhead, and a second end in fluid communication with a control line. The THRT also includes a piston disposed within the tube to balance a pressure differential between a first fluid within the annulus and a second fluid within the control line. In this configuration, conduits extending to the surface vessel which apply pressure to the control lines may be obviated. The combination of the pressure release valve, the soft landing system and the pressure equalization system, along with other features described below, may enable the THRT to control each function of the tubing hanger running process without the umbilical line, thereby reducing time and expense associated with tubing hanger running operations.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20. The wellhead hub 18 generally includes a large diameter hub that is disposed at the termination of the well-bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes a production tree 22, a tubing spool 24, a casing spool 26, and a tubing hanger 28. The system 10 may include other devices that are coupled to the wellhead 12, and devices that are used to assemble and control various components of the wellhead 12. For example, in the illustrated embodiment, the system 10 includes a tubing hanger running tool (THRT) 30 suspended from a drill string 32. In certain embodiments, the THRT 30 is lowered (e.g., run) from an offshore vessel to the well 16 and/or the wellhead 12.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 34. The tree bore 34 provides for completion and workover procedures, such as the insertion of tools (e.g., the hanger 28) into the well 16, the injection of various chemicals into the well 16 (down-hole), and the like. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 36 may also be included, either as a part of the tree 22 or as a separate device. The BOP 36 may consist of a variety of valves, fittings and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 38, and the casing spool 26 includes a casing spool bore 40. The bores 38 and 40 connect (e.g., enables fluid communication between) the tree bore 34 and the well 16. Thus, the bores 38 and 40 may provide access to the well bore 20 for various completion and workover procedures. For example, components can be run down to the wellhead 12 and disposed in the tubing spool bore 38 and/or the casing spool bore 40 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as mandrels, seals, plugs and valves, to control and regulate the well 16. For example, the illustrated tubing hanger 28 is typically disposed within the wellhead 12 to secure tubing suspended in the well bore 20, and to provide a path for hydraulic control fluid, chemical injections, and the like. The hanger 28 includes a hanger bore 42 that extends through the center of the hanger 28, and that is in fluid communication with the casing spool bore 40 and the well bore 20.

As discussed in detail below, the THRT 30 includes certain unique features configured to facilitate running operations without the use of an umbilical line which extends from a surface vessel or platform to the THRT 30. Specifically, certain embodiments of the THRT 30 include an integrated pressure release valve configured to maintain sufficient hydraulic pressure to the subsurface safety valve (SSV) to hold the SSV in the open position during the running process. The pressure release valve is also configured to release hydraulic pressure from the SSV upon contact with the wellhead 12, thereby inducing the SSV to transition to a closed position. Further embodiments of the THRT 30 include an integrated soft landing system having an annular chamber configured to contain sufficient hydraulic fluid to suspend a THRT body relative to an outer casing of the THRT 30. The THRT 30 also includes a valve in fluid communication with the annular chamber such that activation of a release mechanism opens the valve to facilitate flow of hydraulic fluid from the annular chamber to an annulus of the wellhead 12, thereby lowering the tubing hanger 28 into the tubing spool 24. Yet further embodiments of the THRT 30 include an integrated pressure equalization system which automatically maintains a suitable pressure within down-hole control lines. In certain embodiments, the pressure equalization system includes a tube having a first end in fluid communication with the annulus, and a second end in fluid communication with a control line. A piston is configured to move within the tube to balance a pressure differential between a first fluid within the annulus and a second fluid within the control line. The combination of pressure release valve, soft landing system and pressure equalization system may enable the THRT 30 to control each function of the tubing hanger running process without the umbilical line, thereby reducing time and expense associated with tubing hanger running operations.

Figure 2:
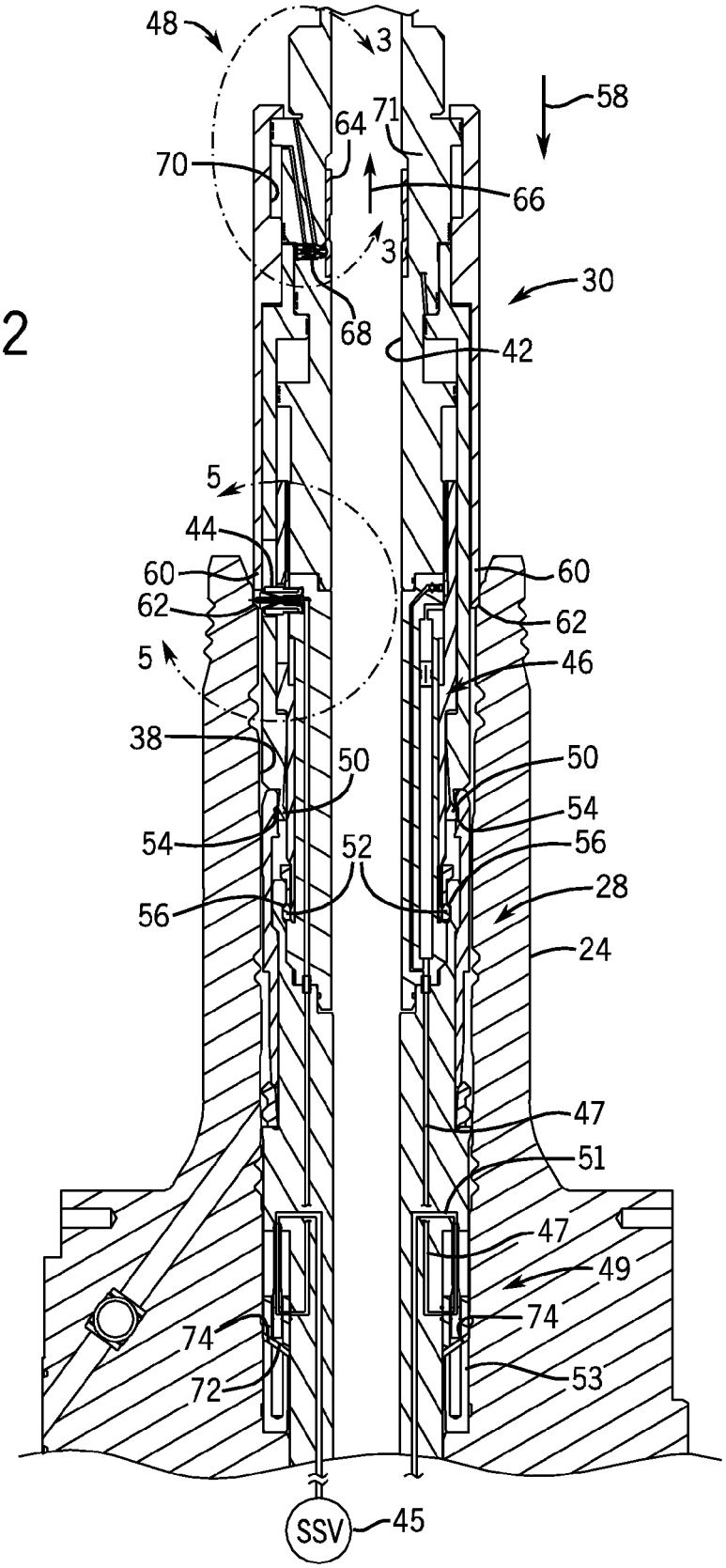
FIG. 2 is a cross-sectional view of an exemplary tubing hanger running tool including an integrated pressure release valve in accordance with certain embodiments of the present technique.

FIG. 2 is a cross-sectional view of an exemplary THRT 30 including an integrated pressure release valve 44 configured to maintain hydraulic pressure within a subsurface safety valve (SSV) 45 during running of the tubing hanger 28. As will be appreciated, an SSV 45 may be positioned within the tubing spool bore 38 downstream from the tubing hanger 28 to block flow of production fluids in an emergency situation. Certain SSVs are hydraulically operated, and biased toward a closed position (i.e., failsafe closed) to ensure that the SSV 45 closes if the system experiences a reduction in hydraulic pressure. For example, in certain configurations, springs induce the SSV 45 to remain in the closed position until sufficient hydraulic pressure is applied to overcome the spring bias and open the SSV 45. If hydraulic pressure to the SSV 45 is reduced, either intentionally or through a system failure, the springs will induce the SSV 45 to return to the closed position, thereby blocking production fluids from passing through the hanger bore 42.

As will be further appreciated, the SSV 45 may be run into the tubing spool 24 in a similar manner to the tubing hanger 28. Specifically, as described above, the THRT 30 may lower the tubing hanger 28 and the SSV 45 through the bores of the BOP 36, tree 22, and tubing spool 24. With the SSV 45 in a closed position, a substantial seal may be formed between the bores 34 and 38 and the tubing hanger 28 due to the substantial similarity in diameters between the bores 34 and 38 and the tubing hanger 28. Consequently, as the tubing hanger 28 and SSV 45 are run, pressure may rise below the SSV 45, thereby increasing resistance to downward motion. Accordingly, it may be desirable to run the tubing hanger 28 and the SSV 45 with the SSV 45 in the open position to equalize pressure on each side the SSV 45. However, as previously discussed, the SSV 45 may be biased toward the closed position. Therefore, to maintain the SSV 45 in the open position during running of the tubing hanger 38 and SSV 45, hydraulic pressure may be continuously supplied to the SSV 45.

In certain configurations, the hydraulic pressure is supplied to the SSV 45 by an umbilical line that extends to a vessel or floating platform at the surface of the sea. Unfortunately, due to the length of the umbilical line, deployment may be a costly and time consuming processing. In addition, the umbilical line may consume large amounts of space on the deck of the vessel or platform which could be utilized for other equipment. Consequently, the present embodiment utilizes a static pressure system to maintain sufficient hydraulic pressure to the SSV 45 such that the SSV 45 remains in the open position during the running process, thereby obviating the umbilical line. Specifically, the THRT 30 includes the pressure release valve 44 in fluid communication with the SSV 45. Prior to running, hydraulic fluid is supplied to the SSV 45 by injecting fluid through the valve 44. As discussed in detail below, because the valve 44 is biased toward a closed position, the valve 44 may maintain hydraulic pressure to the SSV 45 as the SSV 45 and tubing hanger 28 are run into the tubing spool 24. Upon contact between the valve 44 and the tubing spool bore 38, the valve 44 will open, thereby releasing hydraulic pressure and causing the SSV 45 to transition to the closed position.

Because the valve 44 is integrated within the THRT 30, valve maintenance may be performed at regular intervals. As discussed in detail below, after the tubing hanger 28 is mounted to the tubing spool 24, the THRT 30 may be extracted from the wellhead 12. Once on the surface, an operator may service the valve 44 and/or any other component within the THRT 30. In contrast, if a similar valve were coupled to the tubing hanger 28, the valve would be substantially inaccessible because the tubing hanger 28 may be permanently mounted to the tubing spool 24. Therefore, by integrating the valve 44 with the THRT 30, valve maintenance may be performed prior and/or subsequent to each use of the THRT 30.

The illustrated embodiment of the THRT 30 also includes a pressure equalization system 46 configured to equalize pressure to various control lines that extend down the well bore 20. For example, chemical injection lines, hydraulic valve actuation lines, and/or other control lines may extend from the wellhead 12 through the tubing hanger 28, and into the well bore 20. As will be appreciated, fluid couplings or connectors may be attached to the tubing spool 24 and tubing hanger 28 to provide a fluid coupling between lines within the tubing spool 24 and lines within the tubing hanger 28. In such a configuration, as the tubing hanger 28 is lowered into the tubing spool 24, the connectors may automatically engage one another upon contact, thereby providing a fluid path from the well bore 20 to the tubing spool 24.

During the tubing hanger running process (i.e., prior to establishing the fluid connection between the tubing spool lines and the tubing hanger lines), the tubing hanger lines are in fluid communication with lines extending to the tubing hanger running tool 30. As illustrated, a tubing hanger control line 47 extends from the tubing hanger running tool 30 to a stab connector assembly 49. In the illustrated position, the stab connector assembly 49 facilitates fluid flow between the tubing hanger control line 47 and a down-hole control line 51. Consequently, during the running process, the down-hole control line 51 is in fluid communication with the tubing hanger running tool 30. As the tubing hanger 28 lands, the stab connector assembly 49 engages a recess 53 within the tubing spool 24. As a result, fluid flow between the tubing hanger control line 47 and the down-hole control line 51 is blocked, and a fluid connection is established between the lines within the tubing spool 24 and the down-hole control line 51. In this manner, fluid flow to the down-hole control line 51 may be regulated from the surface, for example.

As will be appreciated, a pressure differential between the down-hole control line 51 and the corresponding tubing spool line may cause fluid to leak from seals within the stab connector assembly 49 during the connection process. Consequently, pressurizing the fluid within the down-hole control line 51 prior to connection with the tubing spool line may facilitate a fluid connection between the lines without substantial fluid leakage. In certain embodiments, the previously described umbilical line may be utilized to pressurize each down-hole control line 51 to a pressure substantially equal to the surrounding completion fluid. However, as previously discussed, due to the length of the umbilical line, deployment may be a costly and time consuming processing. In addition, the umbilical line may consume large amounts of space on the deck of the vessel or platform which could be utilized for other equipment. Consequently, the present embodiment includes the pressure equalization system 46 integrated within the THRT 30 to automatically pressurize the control lines to a pressure substantially equal to the surrounding completion fluid without utilizing the umbilical line.

As discussed in detail below, the pressure equalization system 46 includes a piston disposed within a tube. One side of the tube is in fluid communication with the completion fluid, while the other side of the tube is in fluid communication with a control line. In the present configuration, the pressure equalization system 46 may be coupled to a control line within the tubing hanger 28 by a stab connection, for example. As the tubing hanger 28 and THRT 30 are lowered into the tubing spool 24, pressure within the completion fluid increases due to increasing water pressure. Consequently, the completion fluid applies a force to the piston, thereby causing the piston to pressurize the fluid within the control line. The piston is configured to increase the control fluid pressure to substantially match the pressure of the completion fluid, while blocking passage of completion fluid into the control line. As a result, the pressure within the tubing hanger control lines may be substantially equal to the pressure of the surrounding completion fluid, thereby facilitating coupling between the tubing hanger lines and the tubing spool lines. In the present configuration, a separate pressure equalization system 46 may be employed for each control line. Consequently, the control line fluids may be substantially isolated from one another, thereby reducing the possibility of fluid mixing between lines.

Certain drilling strings 32 employ a similar pressure equalization system within independent modules coupled to the THRT 30. For example, a separate module may be employed to equalize the pressure to each control line. As will be appreciated, certain drilling applications may utilize 2, 4, 6, 8, 10, or more independent control lines. Therefore, a corresponding number of modules may be employed. In contrast, the present pressure equalization system 46 is integrated within the THRT 30, thereby obviating the use of independent modules. Such embodiments may substantially decrease the costs and complexity associated with running operations by reducing the number of components connected to the drilling string 32.

The illustrated embodiment further includes a soft landing system 48 configured to gradually lower the THRT 30 and the tubing hanger 28 into the tubing spool 24. As discussed in detail below, the soft landing system 48 includes an annular chamber disposed between an outer casing of the THRT 30 and a body of the THRT 30. The annular chamber is configured to contain sufficient hydraulic fluid to suspend the body relative to the outer casing. The THRT 30 may also include a valve in fluid communication with the annular chamber and an annulus of the wellhead 12, and a release mechanism coupled to the valve. In such a configuration, activation of the release mechanism opens the valve to facilitate flow of hydraulic fluid from the annular chamber to the annulus of the wellhead 12, thereby lowering the tubing hanger 28 into the tubing spool 24.

As previously discussed, the tubing hanger 28 is coupled to the THRT 30 such that the drilling string 32 may run the tubing hanger 28 into the tubing spool 24. Specifically, the THRT 30 includes first latches 50 and second latches 52 configured to engage first recesses 54 and second recesses 56, respectively, of the tubing hanger 28. Contact between the latches 50 and 52 and the recesses 54 and 56 serves to rigidly couple or "latch" the THRT 30 with the tubing hanger 28. With the tubing hanger 28 latched to the THRT 30, the assembly may be lowered in a direction 58 by the drilling string 32 until downward motion is blocked by contact between an outer casing 60 of the THRT 30 and an inner ledge or lip 62 of the tubing spool 24.

At this point, the soft landing system 48 may be engaged, thereby lowering the THRT 30 and tubing hanger 28 into a "landed" position. As illustrated, the soft landing system 48 includes a release mechanism 64 configured to activate the soft landing system 48 by translating in an upward direction 66. For example, a wire line trip may be lowed into the hanger bore 42 and connected to the release mechanism 64. As the wire line trip is translated in the upward direction 66, the release mechanism 64 engages the soft landing system 48, thereby landing the THRT 30 and tubing hanger 28 within the tubing spool 24.

As discussed in detail below, the release mechanism 64 is coupled to a valve 68 configured to regulate a flow of hydraulic fluid within the soft landing system 48. As the release mechanism 64 slides in the direction 66, the valve 68 is transitioned into an open position, thereby enabling hydraulic fluid to flow out of an annular chamber 70. Specifically, hydraulic fluid from the chamber 70 passes through the open valve 68 and into the annulus or open area between the THRT 30 and the bore 38 of the tubing spool 24. As hydraulic fluid flows out of the chamber 70, a body 71 of the THRT 30 translates in the direction 58 relative to the outer casing 60 such that the tubing hanger 28 is lowered into the landed position. A flow path within the valve 68 may be particularly configured to regulate the speed at which the assembly is lowered, thereby providing the assembly with a soft landing. As illustrated, once the tubing hanger 28 is in the landed position, the tubing hanger 28 will be supported by contact between a lip 72 of the tubing hanger 28 and a ledge 74 of the tubing spool 24.

Certain drilling strings 32 employ a similar soft landing system within an independent module coupled to the THRT 30. In contrast, the present soft landing system 48 is integrated within the THRT 30, thereby obviating the use of the independent module. Such embodiments may substantially decrease the costs and complexity associated with running operations by reducing the number of components connected to the drilling string 32. In addition, the soft landing modules typically drain the hydraulic fluid from the annular chamber into the hanger bore 42, thereby potentially mixing hydraulic fluid with production fluid. Because the present embodiment drains the hydraulic fluid into the annulus, the potential of mixing hydraulic fluid with production fluid is substantially reduced or eliminated.

As previously discussed, certain configurations may utilize a hydraulic line extending from the THRT 30 to the surface vessel to drain hydraulic fluid from the chamber within the THRT, thereby lowering the tubing hanger 28 into position. Because the present embodiment drains the hydraulic fluid into the annulus, the hydraulic line extending to the surface vessel may be obviated. The combination of the pressure release valve 44, the pressure equalization system 46 and the soft landing system 48 of the present embodiments may obviate each hydraulic line within the umbilical line, thereby enabling the THRT 30 to perform various running operations without a separate connection to the surface vessel or platform.

Figure 3:
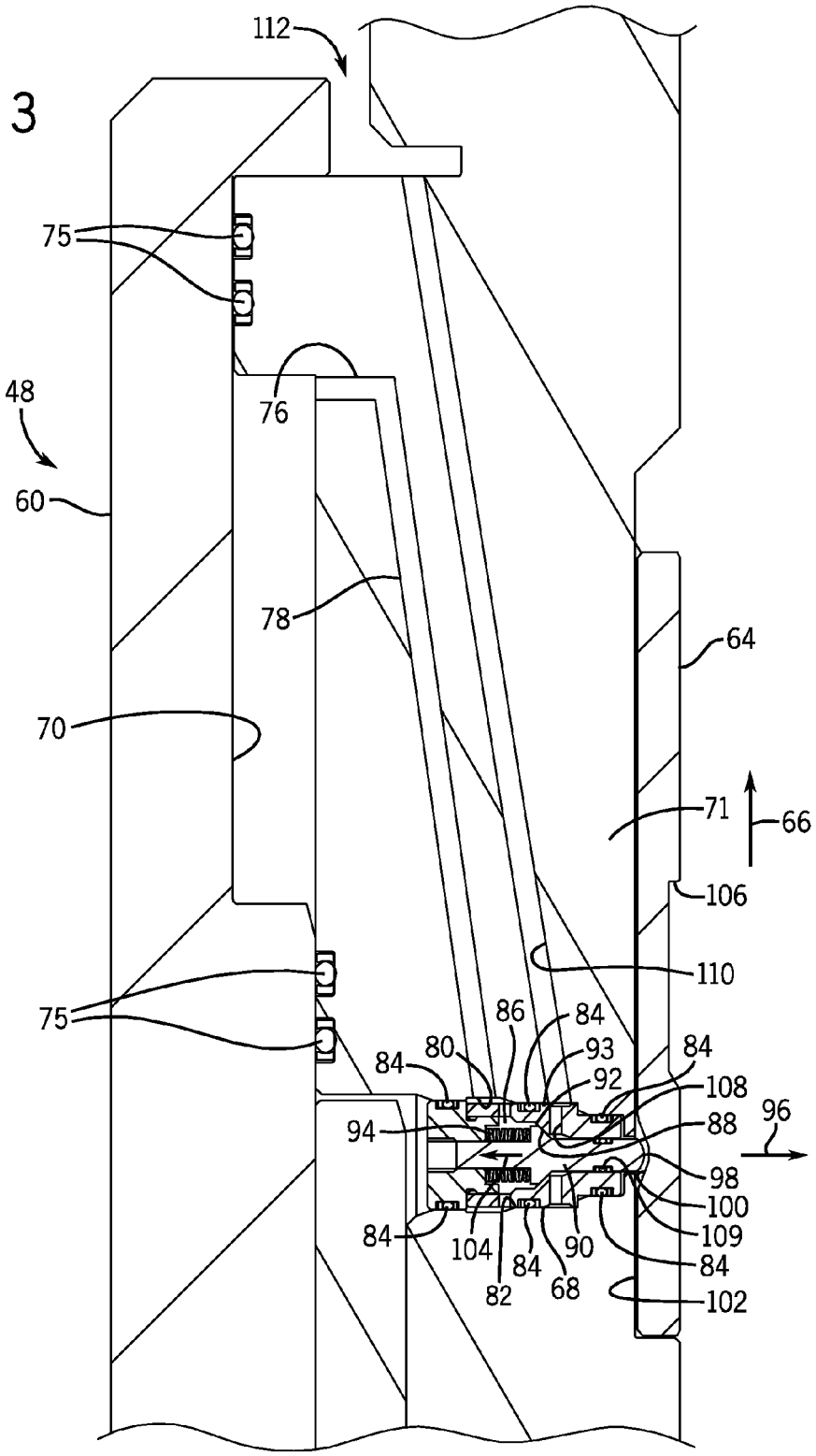
FIG. 3 is a cross-sectional view of a soft landing system, taken within line 3-3 of FIG. 2, in accordance with certain embodiments of the present technique.

FIG. 3 is a cross-sectional view of the soft landing system 48, taken within line 3-3 of FIG. 2. As previously discussed, the soft landing system 48 includes the annular chamber 70 which contains hydraulic fluid. With the valve 68 in the illustrated closed position, the hydraulic fluid is substantially sealed within the chamber 70, thereby supporting the THRT body 71 relative to the outer casing 60. As illustrated, seals 75 (e.g., rubber o-rings) block the flow of hydraulic fluid between the body 71 and outer casing 60 such that the hydraulic fluid is contained within the chamber 70. As previously discussed, the valve 68 is in fluid communication with the annular chamber 70. Specifically, a first fluid conduit 76 and a second fluid conduit 78 fluidly couple the chamber 70 with the valve 68. In the present configuration, the second fluid conduit 78 is coupled to an annular recess 80 within a valve cavity 82. As illustrated, the valve cavity 82 is formed within the body 71 and configured to substantially match the shape of the valve 68. A series of seals 84 serves to block a flow of hydraulic fluid between the valve 68 and the valve cavity 82, thereby substantially reducing or eliminating the possibility of hydraulic fluid leakage.

An internal flow passage 86 is positioned adjacent to the annular recess 80 such that hydraulic fluid may flow into the passage 86. However, with the valve 68 in the closed position, any further flow of hydraulic fluid is blocked by contact between a surface 88 of a valve stem 90 and a surface 92 of a valve body 93. In the present configuration, a spring 94 serves to bias the valve stem 90 toward the valve body 93 in an inward direction 96, thereby inducing contact between the surfaces 88 and 92, and blocking the flow of hydraulic fluid. Consequently, hydraulic fluid may be contained within the chamber 70 such that the body 71 is supported with respect to the outer casing 60.

As previously discussed, the valve 68 may be opened by translating the release mechanism 64 in the direction 66. In the illustrated closed position, a tip 98 of the valve stem 90 is disposed within a recess 100 of the release mechanism 64. However, as the release mechanism 64 translates in the direction 66, the tip 98 of the valve stem 90 will contact a flat surface 102 of the release mechanism 64. As discussed in detail below, contact between the tip 98 and the flat surface 102 will drive the valve stem 90 in an outward direction 104, thereby opening the valve 68 and enabling hydraulic fluid to exit the chamber 70. As previously discussed, a wire line tip may engage a ledge 106 of the release mechanism 64 such that upward movement of the wire line trip causes the release mechanism 64 to translate in the direction 66. Consequently, the valve 68 may be opened from a remote location, thereby facilitating a soft landing of the tubing hanger 28.

As the valve stem 90 is driven in the direction 104, a flow passage will open between the surfaces 88 and 92, thereby enabling hydraulic fluid to flow from the flow passage 86 into a downstream flow passage 108. Further flow of hydraulic fluid in the direction 96 may be blocked by a seal 109 (e.g., rubber o-ring) disposed between the valve stem 90 and the valve body 93. The downstream flow passage 108 is in fluid communication with a third fluid conduit 110. Therefore, hydraulic fluid passing through the valve 68 will enter the third fluid conduit 110 and exit into an annulus 112 between the THRT 30 and the tubing spool 24. As will be appreciated, the annulus 112 may be filled with completion fluid which will mix with the hydraulic fluid from the soft landing system 48. By integrating the soft landing system 48 into certain embodiments of the THRT 30, a separate module within the running string may be eliminated, thereby providing a more compact and self-contained tubing hanger assembly. Furthermore, because an independent hydraulic line is not utilized to drain hydraulic fluid from the chamber 70, the umbilical line extending between the THRT 30 and the surface vessel or platform may be obviated.

While a poppet valve 68 is employed in the present embodiment, it should be appreciated that alternative embodiments may utilize other valve configurations. For example, further embodiments may employ a rotary valve, a can valve, a disk valve, a slide valve, a shuttle valve, a gate valve, or any other suitable actuated valve apparatus. Furthermore, while the present embodiment utilizes a sliding release mechanism 64, it should be appreciated that alternative embodiments may employ other release mechanisms, such as buttons, latches, etc. Regardless of the valve and release mechanism configurations, the present embodiments are configured to release hydraulic fluid from a chamber via a remote location, thereby gradually lowering the tubing hanger 28 into the landed position.

Figure 4:
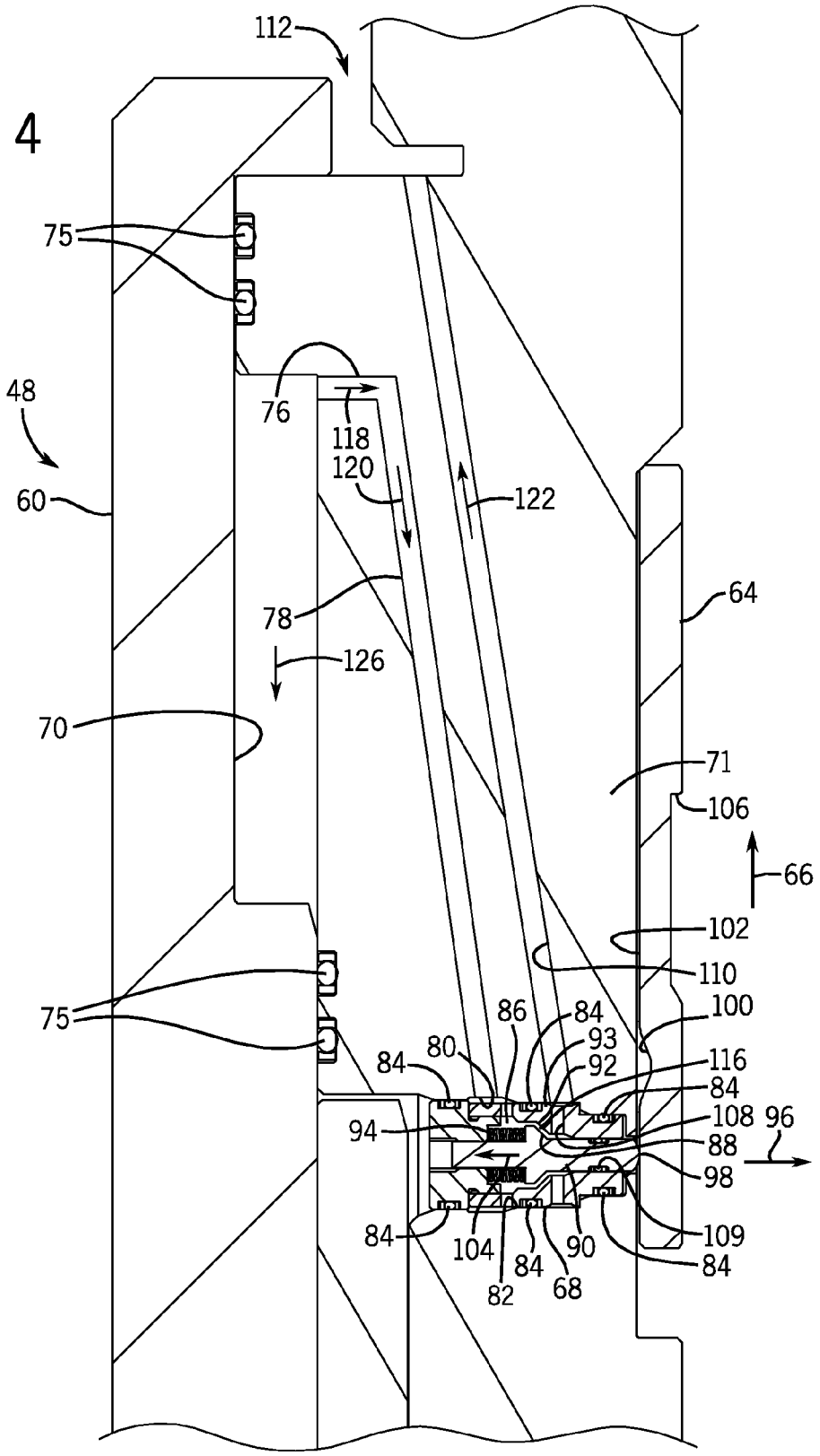
FIG. 4 is a cross-sectional view of the soft landing system shown in FIG. 3, having a valve in an open position, in accordance with certain embodiments of the present technique.

FIG. 4 is a cross-sectional view of the soft landing system 48 shown in FIG. 3, in which the valve 68 is in the open position. As illustrated, the release mechanism 64 has been translated in the direction 66, resulting in contact between the flat surface 102 and the tip 98 of the valve stem 90. Consequently, the valve stem 90 has translated in the direction 104, thereby opening a flow passage 116 between the surface 88 of the valve stem 90 and the surface 92 of the valve body 93. With the valve 68 in the open position, a complete flow path may be established between the annular chamber 70 and the annulus 112. Specifically, hydraulic fluid may flow from the annular chamber 70 through the first fluid conduit 76 in the direction 118. The hydraulic fluid may then flow in a direction 120 along the second fluid conduit 78 into the valve 68. As previously discussed, hydraulic fluid may enter the annular recess 80, flow through the flow paths 86, 116, and 108, and enter the third fluid conduit 110. The hydraulic fluid may then flow through the conduit 110 in a direction 122, and exit to the annulus 112.

The rate of fluid flow may be regulated by the diameter of the fluid conduits 76, 78 and/or 110, and/or the flow paths within the valve 68. As will be appreciated, the speed at which the body 71 moves in a direction 126 relative to the outer casing 60 is at least partially dependent on the rate at which the hydraulic fluid exits the chamber 70. As previously discussed, because the tubing hanger 28 is latched to the body 71, movement of the body 71 in the direction 126 causes the tubing hanger 28 to move in the direction 58. Once the tubing hanger 28 is in the landed position, the tubing hanger 28 will be supported by contact between the lip 72 of the tubing hanger 28 and the ledge 74 of the tubing spool 24.

Figure 5:
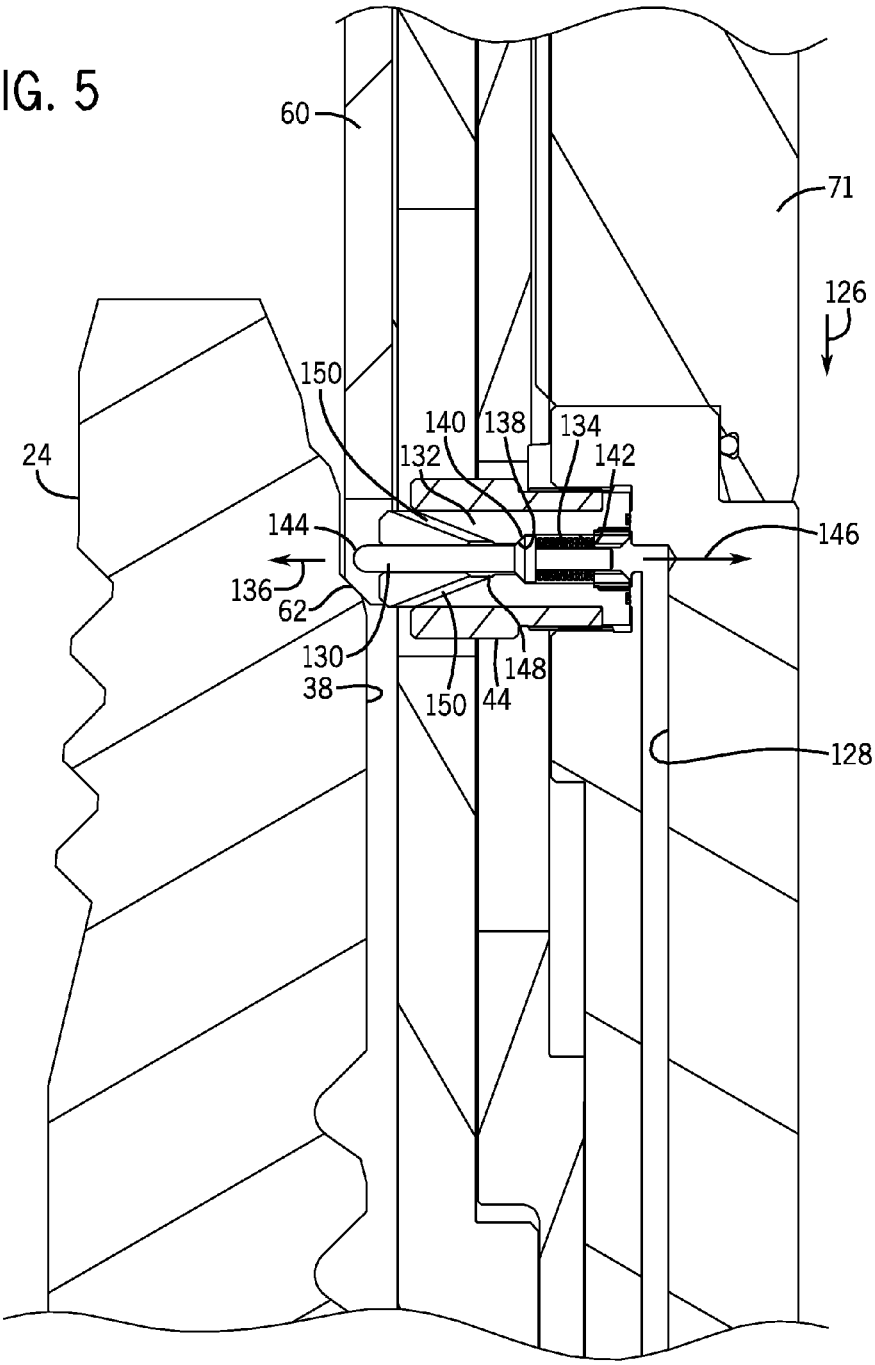
FIG. 5 is a cross-sectional view of a pressure release valve, taken within line 5-5 of FIG. 2, in accordance with certain embodiments of the present technique.

FIG. 5 is a cross-sectional view the pressure release valve 44, taken within line 5-5 of FIG. 2. As illustrated, the pressure release valve 44 is coupled to a fluid conduit 128. As discussed in detail below, the fluid conduit 128 extends through the THRT 30 and terminates in a connector (e.g., stab-type connector). A corresponding connector within the tubing hanger 28 couples to the THRT connector, and a second fluid conduit extends between the tubing hanger connector and the SSV 45. While the THRT 30 is coupled to the tubing hanger 28, the conduits and connectors within the THRT 30 and tubing hanger 28 (including the conduit 128) establish a direct fluid connection between the valve 44 and the SSV 45. Consequently, prior to running the tubing hanger 28, hydraulic fluid may be injected into the fluid conduits through the valve 44, e.g., by a specialized fluid injection tool. With the tool removed and the valve 44 in the closed position, a static pressure may be maintained within the conduits sufficient to hold the SSV 45 in the open position. As a result, the tubing hanger 28 and SSV 45 may be run without substantial fluid resistance.

In the present configuration, the valve 44 is a poppet valve similar to the previously described valve 68 within the soft landing system 48. As illustrated, the valve 44 includes a valve stem 130 and a valve body 132. A spring 134 serves to bias the valve stem 130 in a direction 136 such that the valve stem 130 contacts the valve body 132 while the valve 44 is in the closed position. Specifically, a surface 138 of the valve stem 130 contacts a surface 140 of the valve body 132 to block a flow of hydraulic fluid from a flow path 142 in fluid communication with the conduit 128. Consequently, the hydraulic pressure within the system may be substantially maintained as long as the valve 44 is in the closed position.

In the illustrated position, downward movement of the outer casing 60 of the THRT 30 is blocked by the inner ledge or lip 62 of the tubing spool 24. However, as previously discussed, once the soft landing system 48 is engaged, the body 71 of the THRT 30 will move in the direction 126, thereby lowering the tubing hanger 28 into the landed position. Because the valve 44 is coupled to the body 71, movement of the body 71 in the direction 126 causes the valve 44 to move past the ledge 62 and engage the bore 38 of the tubing spool 24. As discussed in detail below, contact between a tip 144 of the valve stem 130 and the tubing spool bore 38 causes the valve stem 130 to translate in a direction 146, thereby opening a flow passage between the surface 138 of the valve stem 130 and the surface 140 of the valve body 132. As a result, hydraulic fluid may flow from the conduit 128, through the flow passage 142, and into a flow passage 148. The fluid may then exit the valve 44 through flow passages 150. As hydraulic fluid exits the valve 44, the pressure within the conduit 128 will decrease, thereby inducing the SSV 45 to transition to the closed position. While the valve 44 is disposed along an outer surface of the THRT 30 in the illustrated embodiment, it should be appreciated that alternative embodiments may employ a pressure release valve 44 disposed along an inner surface of the THRT 30. In such embodiments, contact between the pressure release valve 44 and a coexisting external moving part may drive the pressure release valve 44 toward the open position.

As previously discussed, because the valve 44 serves to maintain hydraulic pressure to the SSV 45 during the running operation, the present embodiment may obviate the umbilical line used to provide hydraulic fluid to the SSV 45. Because the present embodiment does not utilize the umbilical line, costs and time associated with the running operation may be significantly reduced. In addition, because the valve 44 is integrated within the THRT 30, valve maintenance may be performed more frequently than configurations in which a similar valve is located within the tubing hanger 28. For example, valve maintenance may be performed prior and/or subsequent to each use of the THRT 30 because the THRT 30 is extracted from the wellhead 12 after the tubing hanger 28 is mounted to the tubing spool 24. Furthermore, while a poppet valve is utilized in the present embodiment, it should be appreciated that other valve configurations, such as a rotary valve, a can valve, a disk valve, a slide valve, or a gate valve, for example, may be employed in alternative embodiments.

Figure 6:
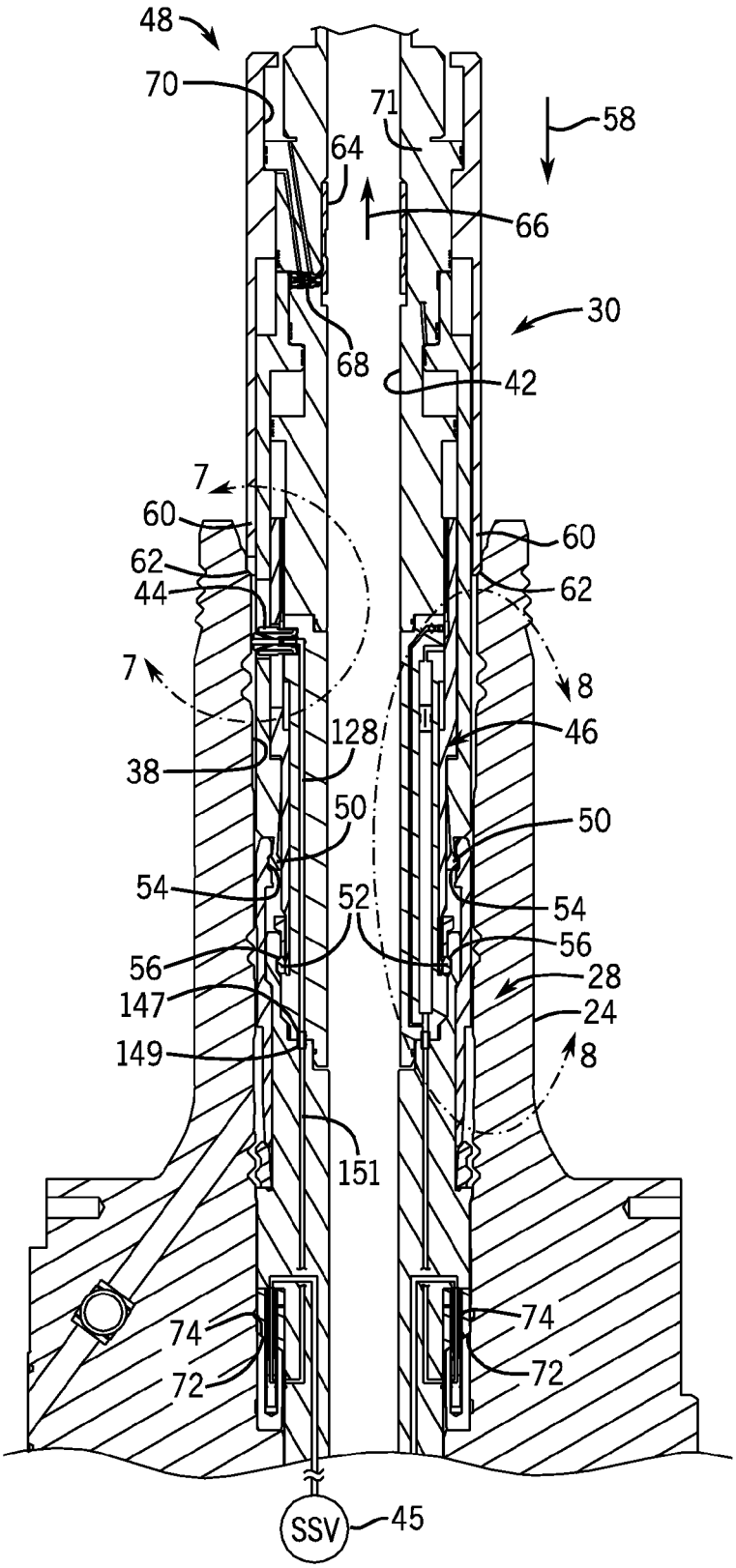
FIG. 6 is a cross-sectional view of the tubing hanger running tool with the tubing hanger in a landed position in accordance with certain embodiments of the present technique.

FIG. 6 is a cross-sectional view of the THRT 30 with the tubing hanger 28 in the landed position. As previously discussed, once the release mechanism 64 has been translated in the direction 66, the soft landing system 48 gradually lowers the body 71 of the THRT 30, thereby landing the tubing hanger 28 in the illustrated position. In the landed position, the tubing hanger 28 is supported by contact between the lip 72 of the tubing hanger 28 and the ledge 74 of the tubing spool 24. Furthermore, contact between the valve 44 and the tubing spool bore 38 releases hydraulic pressure within the static pressure system, thereby enabling the SSV 45 to transition to the closed position. As illustrated, the hydraulic conduit 128 within the THRT 30 extends from the valve 44 to a connector 147 (e.g., stab connector) which interfaces with a corresponding connector 149 within the tubing hanger 28. The tubing hanger connector 149 is coupled to a conduit 151 which extends to the SSV 45. Therefore, the valve 44 is in fluid communication with the SSV 45 via the conduits 128 and 151, and the connectors 147 and 149. As discussed in detail below, once the tubing hanger 28 is in the landed position, the tubing hanger 28 may be locked to the tubing spool 24. The THRT 30 may then be unlatched from the tubing hanger 28 and extracted from the wellhead 12 by the drilling string 32. Upon extraction, the THRT connector 147 will disengage the tubing hanger connector 149, thereby separating the valve 44 from the SSV 45. However, once the tubing hanger 28 is in the landed position, the SSV 45 may be fluidly coupled to control lines within the tubing spool 24 such that the SSV 45 may be operated from a surface vessel or platform.

Figure 7:
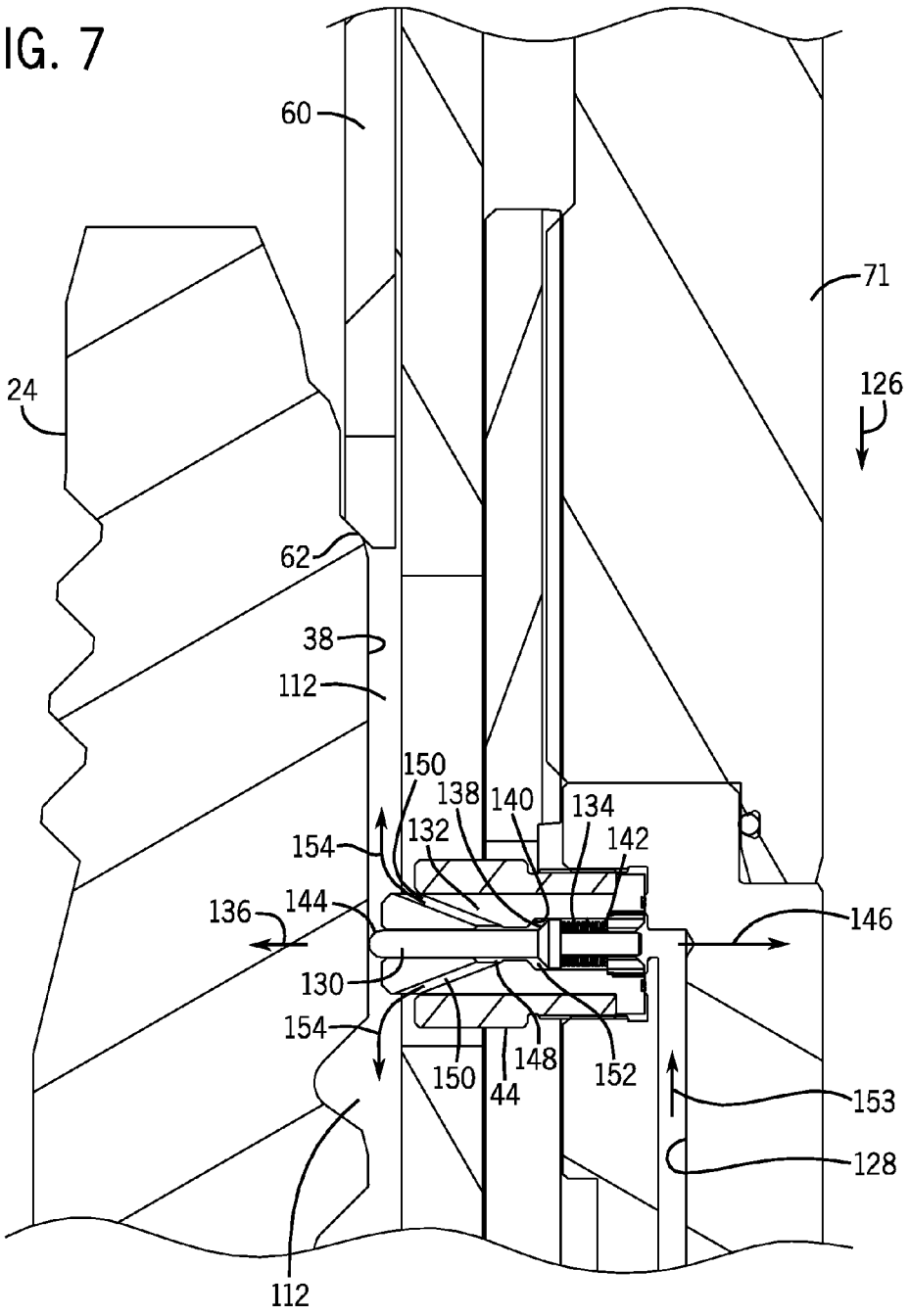
FIG. 7 is a cross-sectional view of the pressure release valve in an open position, taken within line 7-7 of FIG. 6, in accordance with certain embodiments of the present technique.

FIG. 7 is a cross-sectional view of the pressure release valve 44 in an open position, taken within line 7-7 of FIG. 6. As illustrated, contact between the tip 144 of the valve stem 130 and the tubing spool bore 38 induced the valve stem 130 to translate in the direction 146. As a result, a flow path 152 is formed between the surface 138 of the valve stem 130 and the surface 140 of the valve body 132. Consequently, hydraulic fluid may flow in a direction 153 from the conduit 128 into the flow passage 142 of the valve 44. The hydraulic fluid may then flow through the valve 44 via the passages 142, 152 and 150. Finally, the fluid may exit the valve 44 in the direction 154, and flow into the annulus 112. The rate of fluid flow may be regulated by the diameter of the fluid conduit 128, and/or the flow paths within the valve 44. As will be appreciated, the speed at which the SSV 45 closes is at least partially dependent on the rate at which the hydraulic fluid exits the valve 44. To protect structures within the SSV 45, the conduit 128 and/or valve 44 may be particularly configured to provide a gradual transition to the closed position.

As previously discussed, maintaining the SSV 45 in the open position during running of the tubing hanger 28 and SSV 45 may facilitate pressure equalization above and below the SSV 45, thereby decreasing resistance to downward motion. However, once the tubing hanger 28 is in the landed position, closing the SSV 45 will no longer impede movement because the SSV 45 and the tubing hanger 28 are substantially in their final position. In addition, transitioning the SSV 45 to the closed position may block the flow of production fluids from entering the wellhead 12. Finally, because hydraulic pressure to the SSV 45 has been substantially reduced, a connection between the SSV 45 and control lines within the wellhead 12 may be established such that the SSV 45 may be controlled from a vessel on the surface of the sea.

Figure 8:
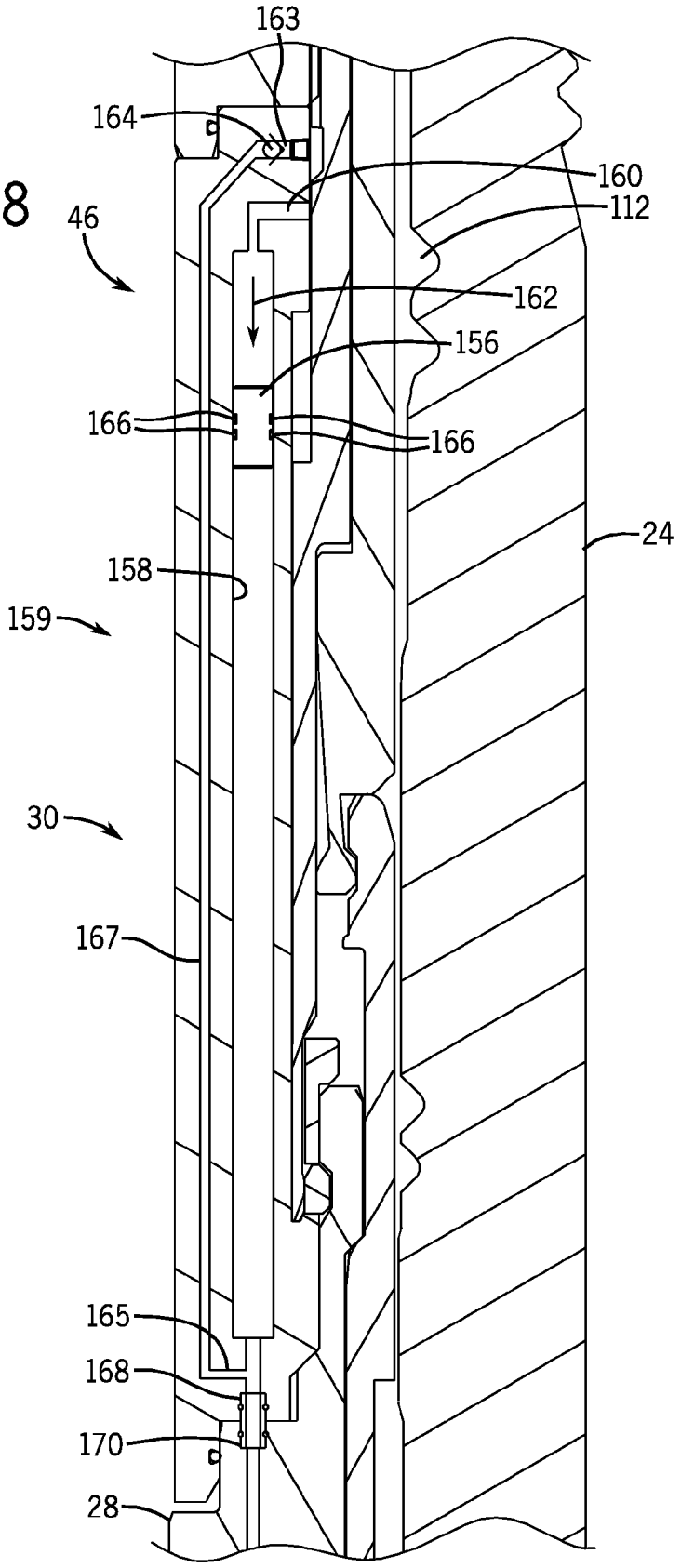
FIG. 8 is a cross-sectional view of a pressure equalization system, taken within line 8-8 of FIG. 6, in accordance with certain embodiments of the present technique.

FIG. 8 is a cross-sectional view of the pressure equalization system 46, taken within line 8-8 of FIG. 6. As illustrated, the pressure equalization system 46 includes a piston 156 disposed within a tube 158. An inlet 160 positioned on a first side of the tube 158 is in fluid communication with the annulus 112. As previously discussed, the annulus 112 may be filled with completion fluid at a pressure substantially equal to the surrounding water pressure. A second end of the tube 158 is in fluid communication with a control line, such as a chemical injection line or a hydraulic valve actuation line, for example. As the tubing hanger 28 and THRT 30 are lowered into the tubing spool 24, pressure within the completion fluid adjacent to the THRT 30 increases due to increasing water pressure. Consequently, the completion fluid may flow into the tube 158 in the direction 162, thereby applying a force to the piston 156.

As will be appreciated, as the piston 156 is driven in the direction 162, fluid pressure within the control line coupled to the second end of the tube 158 will increase. Specifically, the piston 156 is configured to increase the control fluid pressure to match the pressure of the completion fluid, while blocking passage of completion fluid into the control line. In the present configuration, the piston 156 includes seals 166 (e.g., rubber o-rings) configured to maintain a separation between the control fluid and the completion fluid. The present embodiment also includes connectors configured to couple the tube 158 to the control line within the tubing hanger 28. For example, as illustrated, a stab connector 168 within the THRT 30 is configured to interface with a corresponding connector 170 within the tubing hanger 28, thereby coupling the pressure equalization system 46 to the control line. In this manner, fluid pressure within the tubing hanger control lines may be increased to substantially match the pressure of the surrounding completion fluid. In present embodiment, a separate pressure equalization system 46 is utilized for each control line, thereby substantially reducing the possibility of control line fluid mixing.

The illustrated pressure equalization system 46 also includes a gas reduction system 159 including a second inlet 163, a check valve 164, and a port 165 positioned below the tube 158. The port 165 is in fluid communication with the second inlet 163 via a conduit 167. Prior to landing the tubing hanger 28, the gas reduction system may be utilized to decrease the gas (e.g., air) volume of the control line fluid. For example, control line fluid may be injected through the second inlet 163, thereby increasing the fluid pressure within the control line and tube 158. As will be appreciated, increasing fluid pressure decreases the volume of gas within the fluid. Consequently, when the completion fluid applies pressure to the piston 156, movement in the direction 162 is limited because the control line fluid is substantially incompressible. In contrast, if uncompressed gas were present within the tube 158, the piston 156 may be driven to the lower extent to the tube 158, thereby reducing the effectiveness of the pressure equalization system 46. The check valve 164 within the second inlet 163 is configured to facilitate flow of control line fluid into the tube 158, but block fluid flow out of the tube 158. Such a valve 164 may maintain control line fluid pressure within the tube 158 and control line. After the gas volume has been reduced, the second inlet 163 may be sealed.

Equalizing the pressure between the control lines and surrounding completion fluid may facilitate coupling between the control lines within the tubing hanger 28 and control lines within the tubing spool 24, after the tubing hanger 28 has been lowered to the illustrated landed position. For example, the present embodiment may utilize fluid couplings or connectors to attach the respective control lines within the tubing spool 24 and tubing hanger 28. In such a configuration, as the tubing hanger 28 is lowered into the tubing spool 24, the connectors may automatically engage one another upon contact. Equalizing the pressure between the tubing hanger control lines and the completion fluid may serve to protect the seals between the fluid couplings and facilitate a proper connection.

As previously discussed, certain drilling strings 32 may employ a similar pressure equalization system within independent modules coupled to the THRT 30. For example, a separate module may be employed to equalize the pressure to each control line. As will be appreciated, certain drilling applications may utilize 2, 4, 6, 8, 10, or more independent control lines. Therefore, a corresponding number of modules may be employed. In contrast, the present pressure equalization system 46 is integrated within the THRT 30, thereby obviating the use of independent modules. Such embodiments may substantially decrease the costs and complexity associated with running operations by reducing the number of components connected to the drilling string 32.

Furthermore, the present embodiment may obviate independent lines extending from the surface vessel or platform to the THRT 30. Specifically, by providing the pressure equalization system 46 within the THRT 30, control line fluid pressure may be automatically adjusted to a desired level without the use of external pressurization. As a result, pressurizing lines within the umbilical line may be obviated. Furthermore, the combination of the pressure release valve 44, the soft landing system 48 and the pressure equalization system 46 may enable the THRT 30 to control each function of the tubing hanger running process without the umbilical line, thereby reducing time and expense associated with tubing hanger running operations.

Figure 9:
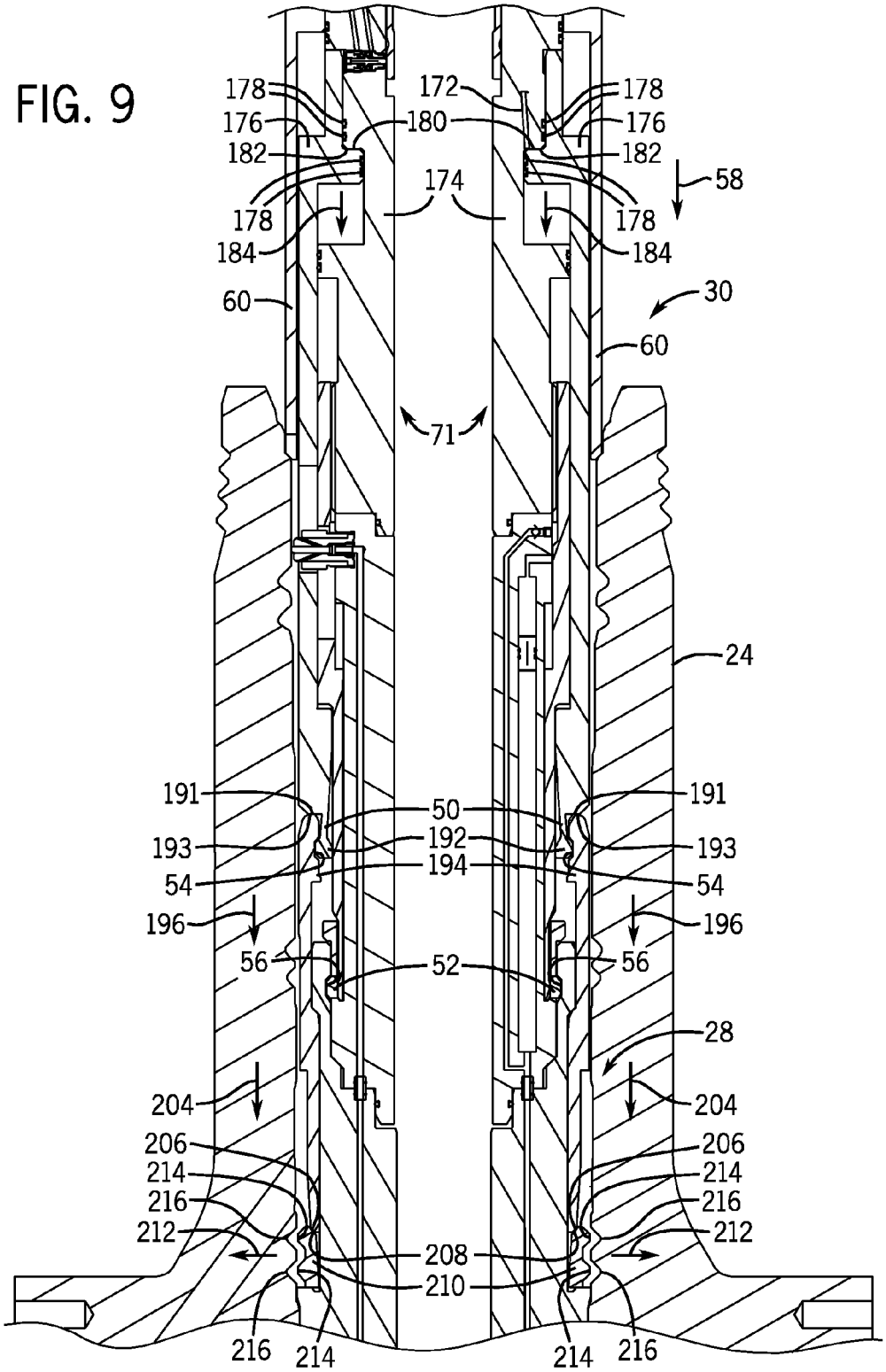
FIG. 9 is a cross-sectional view of the tubing hanger running tool and tubing hanger, in which the tubing hanger running tool is latched to the tubing hanger and the tubing hanger is unlocked from the tubing spool, in accordance with certain embodiments of the present technique.

FIG. 9 is a cross-sectional view of the THRT 30 and tubing hanger 28, in which the THRT 30 is latched to the tubing hanger 28 and the tubing hanger 28 is unlocked from the tubing spool 24. As previously discussed, the tubing hanger 28 is lowered into the tubing spool 24 by the drilling string 32. Specifically, during the running process, the tubing hanger 28 is latched to the THRT 30, thereby coupling the tubing hanger 28 to the drilling string 32. Once the tubing hanger 28 has been lowered into the landed position, the tubing hanger 28 may be permanently coupled or locked to the tubing spool 24. The THRT 30 may then be unlatched from the tubing hanger 28 and extracted from the wellhead 12 by the drilling string 32. As discussed in detail below, the process of locking the tubing hanger 28 to the tubing spool 24, and unlatching the THRT 30 from the tubing hanger 28 may be accomplished without the use of hydraulic connections provided by an umbilical line. Consequently, the present embodiment may completely obviate the umbilical line for running operations, thereby reducing duration and costs associated with umbilical line deployment.

In certain configurations, the process of locking the tubing hanger 28 to the tubing spool 24 may be initiated by the BOP 36. As will be appreciated, the BOP 36 may include "choke and kill" lines which extend from the BOP 36 to a vessel or platform on the surface of the sea. In certain BOP configurations, the choke and kill lines may be used for testing pipe rams and/or performing other functions related to BOP operation. In the present embodiment, the choke and kill lines may also provide hydraulic fluid to the THRT 30 such that the THRT 30 may lock the tubing hanger 28 to the tubing spool 24. Specifically, after the tubing hanger 28 has landed, hydraulic pressure from the choke and kill lines will induce movement of various components within the THRT 30, thereby driving a locking mechanism within the tubing hanger 28 to engage the tubing spool 24.

In the present embodiment, the THRT 30 includes a hydraulic line 172, which is coupled to a choke and kill line of the BOP 36. As illustrated, the hydraulic line 172 terminates at an interface between a fixed component 174 and a movable actuating component 176 of the THRT body 71. A series of seals 178 (e.g., rubber o-rings) serves to substantially confine the hydraulic fluid provided from the line 172 to a region between a substantially horizontal surface 180 of the fixed component 174 and a substantially horizontal surface 182 of the movable actuating component 176. As hydraulic fluid is delivered into this region, a force is applied between the horizontal surfaces 180 and 182, thereby driving the movable actuating component 176 in a downward direction 184.

As illustrated, the latches 50 are coupled to the movable actuating component 176 such that movement of the component 176 drives the latches 50 downward in the direction 184. In certain configurations, each latch 50 may include a protrusion disposed within a recess of the movable actuating component 176. Consequently, contact between the protrusion and the recess induces the latch 50 to move in the downward direction 184. In addition, as discussed in detail below, the latches 50 are configured to rotate about a pivot with respect to the component 176. Each latch 50 also includes a tang 192 configured to interface with the recess 54 of a movable actuating component 194 of the tubing hanger 28. As previously discussed, contact between the tang 192 and the recess 54 serves to latch the THRT 30 with the tubing hanger 28. In addition, a combination of the tang 192 and recess 54 interface, and contact between a surface 191 of the actuating component 176 of the THRT 30 and a surface 193 of the actuating component 194 of the tubing hanger 28, serves to drive the actuating component 194 in a downward direction 196 in response to movement of the actuating component 176.

As illustrated, an angled interface surface 206 of the actuating component 194 interfaces with an angled interface surface 208 of a locking component 210. Consequently, downward movement of the actuating component 194 induces the locking component 210 to move radially outward in a direction 212. As illustrated, the locking component 210 includes a pair of protrusions 214 configured to interlock with a pair of recesses 216 within the tubing spool 24. While two protrusions 214 and recesses 216 are employed in the present embodiment, it should be appreciated that alternative embodiments may employ more or fewer protrusions 214 and recesses 216. Contact between the protrusions 214 of the locking component 210 and the recesses 216 of the tubing spool 24 locks the tubing hanger 28 to the tubing spool 24.

Because the choke and kill lines of the BOP 36 provide the hydraulic pressure to initiate the locking process, no additional hydraulic lines may be employed to lock the tubing hanger 28 with the tubing spool 24. Consequently, the umbilical line which, in certain configurations, provides hydraulic lines to the THRT 30 may be obviated. As a result, the duration and costs associated with umbilical line deployment may be eliminated. Furthermore, because the umbilical line is no longer stored on the deck of the vessel or platform, additional space may be made available for other equipment.

Figure 10:
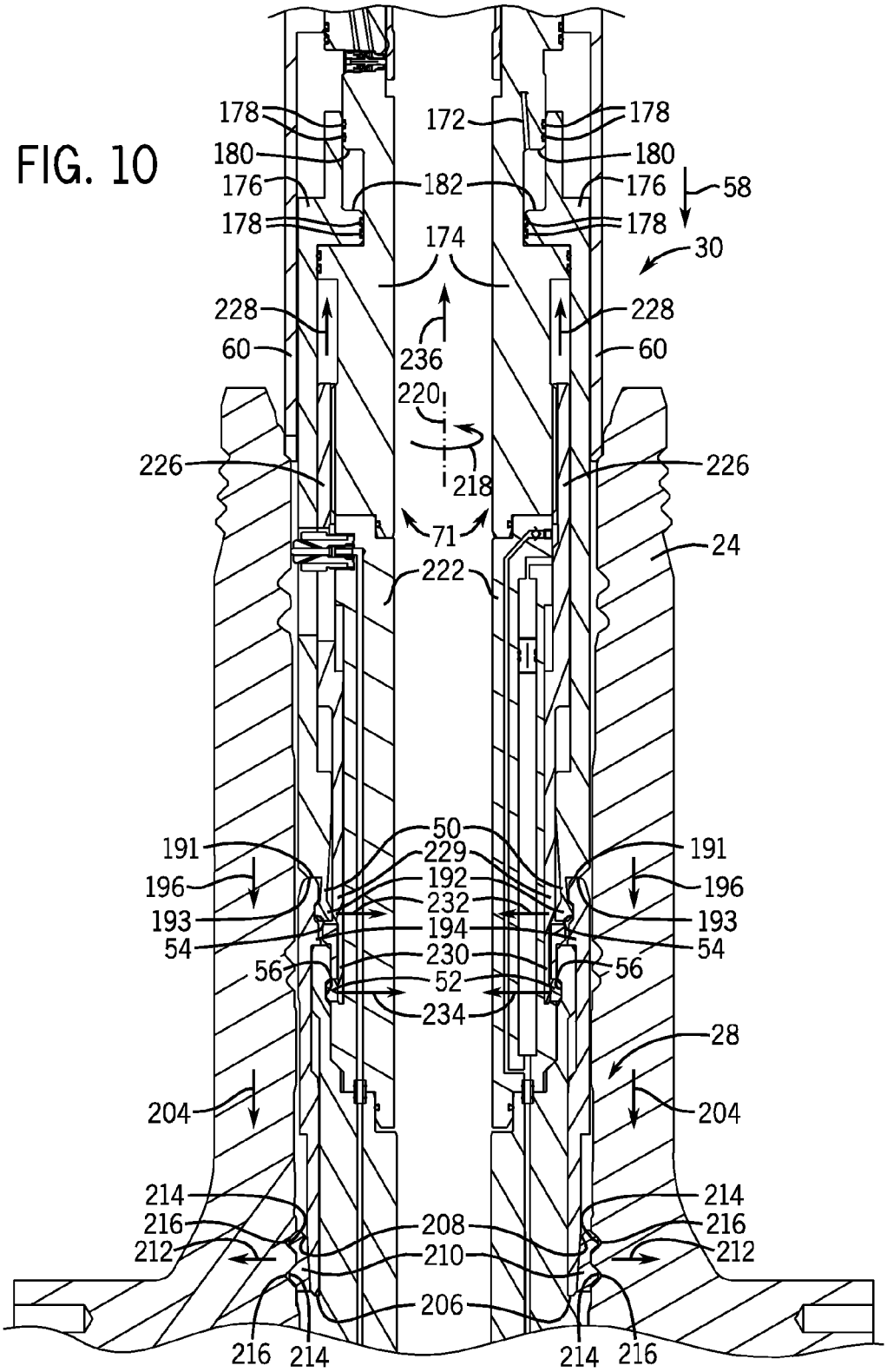
FIG. 10 is a cross-sectional view of the tubing hanger running tool and tubing hanger, in which the tubing hanger running tool is latched to the tubing hanger and the tubing hanger is locked to the tubing spool, in accordance with certain embodiments of the present technique.

FIG. 10 is a cross-sectional view of the THRT 30 and tubing hanger 28, in which the THRT 30 is latched to the tubing hanger 28 and the tubing hanger 28 is locked to the tubing spool 24. As illustrated, hydraulic fluid from a BOP choke and kill line has passed through the hydraulic line 172, thereby inducing the movable actuating component 176 to translate in the direction 184. Due to contact between the movable actuating component 176 of the THRT 30 and the movable actuating component 194 of the tubing hanger 28, the component 194 has been driven downward in the direction 196, thereby inducing the locking component 210 to engage the tubing spool 24. As previously discussed, contact between the protrusions 214 of the locking component 210 and the recesses 216 of the tubing spool 24 lock the tubing hanger 28 to the tubing spool 24.

Once the locking process is complete, the THRT 30 may be unlatched from the tubing hanger 28 and extracted from the wellhead 12. To unlatch the THRT 30 from the tubing hanger 28, the latches 50 and 52 may be disengaged from the respective recesses 54 and 56. In the present embodiment, the unlatching process may be initiated by rotation of the drilling string 32. Because the drilling string 32 is rotationally coupled to the fixed component 174 of the body 71, rotation of the drilling string 32 may induce the fixed component 174 to rotate in a circumferential direction 218 about a longitudinal axis 220. In the present embodiment, an interface component 222 is rotationally coupled to the tubing hanger 28, which is locked to the tubing spool 24. Consequently, rotation of the drilling string 32 induces the fixed component 174 to rotate relative to the interface component 222. To facilitate rotation of the fixed component 174, a thrust bushing or bearing may be disposed at the interface between the fixed component 174 and the interface component 222.

Due to threading between components, rotation of the fixed component 174 moves a latching mechanism driving component 226 in an upward direction 228. As illustrated, the driving component 226 includes a thick portion 229 positioned adjacent to the latch 50, and a thin portion 230 positioned adjacent to the latch 52. In the illustrated latched position, contact between the thick portion 229 and the tang 192 of the latch 50 induces the tang 192 to engage the recess 54. In addition, contact between the thin portion 230 and the latch 52 induces the latch 52 to engage the recess 56. As the latching mechanism driving component 226 moves upwardly in the direction 228, the thin portion 230 moves into a position adjacent to the latch 50. In certain embodiments, the latch 50 is biased in a radially inward direction 232 about a pivot. Consequently, when the thin portion 230 is positioned adjacent to the tang 192, the tang 192 may translate in the direction 232, thereby disengaging the recess 54. Similarly, the latch 52 may be biased in a radially inward direction 234. Therefore, when the thin portion 230 moves upwardly in the direction 228, the latch 52 may move in the direction 234, thereby disengaging the recess 56. Once the latches 50 and 52 have disengaged the respective recesses 54 and 56, the THRT 30 is unlatched from the tubing hanger 28 and may be extracted by translation in an upward direction 236.

Figure 11:
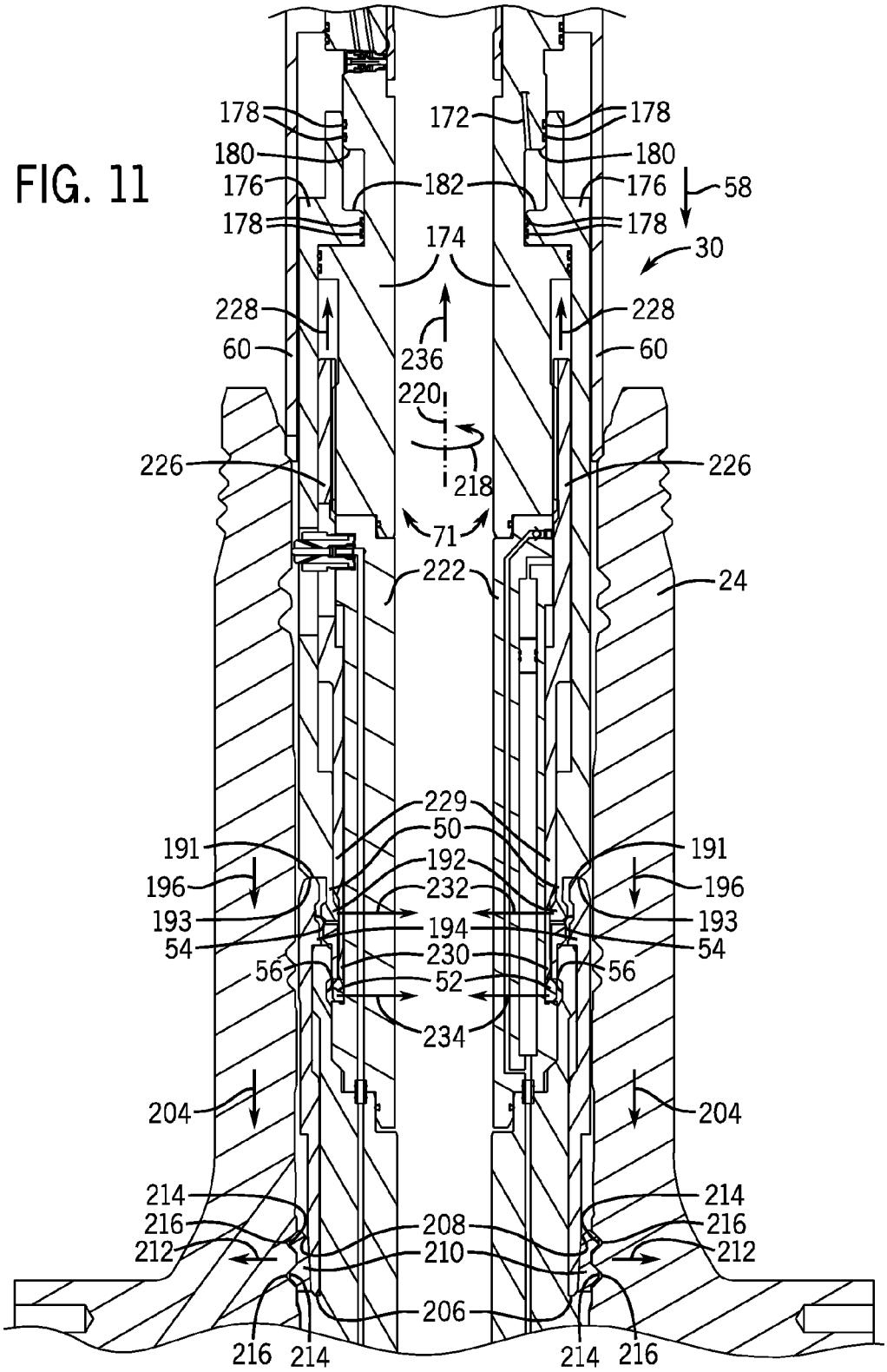
FIG. 11 is a cross-sectional view of the tubing hanger running tool and tubing hanger, in which the tubing hanger running tool is unlatched from the tubing hanger, in accordance with certain embodiments of the present technique.

FIG. 11 is a cross-sectional view of the THRT 30 and tubing hanger 28, in which the THRT 30 is unlatched from the tubing hanger 28. As illustrated, rotation of the fixed component 174 has induced the latching mechanism driving component 226 to translate in the direction 228. As a result, the thin portion 230 of the driving component 226 is presently positioned adjacent to the tang 192 of the latch 50. Because the latch 50 is biased to rotate about the pivot, the tang 192 has moved radially inward in the direction 232, thereby disengaging the recess 54. In addition, because the thin portion 230 no longer blocks inward movement of the latch 52, the latch 52 has moved in the direction 234, thereby disengaging the recess 56. Consequently, the THRT 30 has been unlatched from the tubing hanger 28 and may be removed in the direction 236.

Because rotation of the drilling string 32 initiates the unlatching process, no additional hydraulic lines may be employed to unlatch the THRT 30 from the tubing hanger 28. Consequently, the umbilical line which, in certain configurations, provides hydraulic lines to the THRT 30 may be obviated. As a result, the duration and costs associated with umbilical line deployment may be eliminated. Furthermore, because the umbilical line is no longer stored on the deck of the vessel or platform, additional space may be made available for other equipment.

Figure 12:
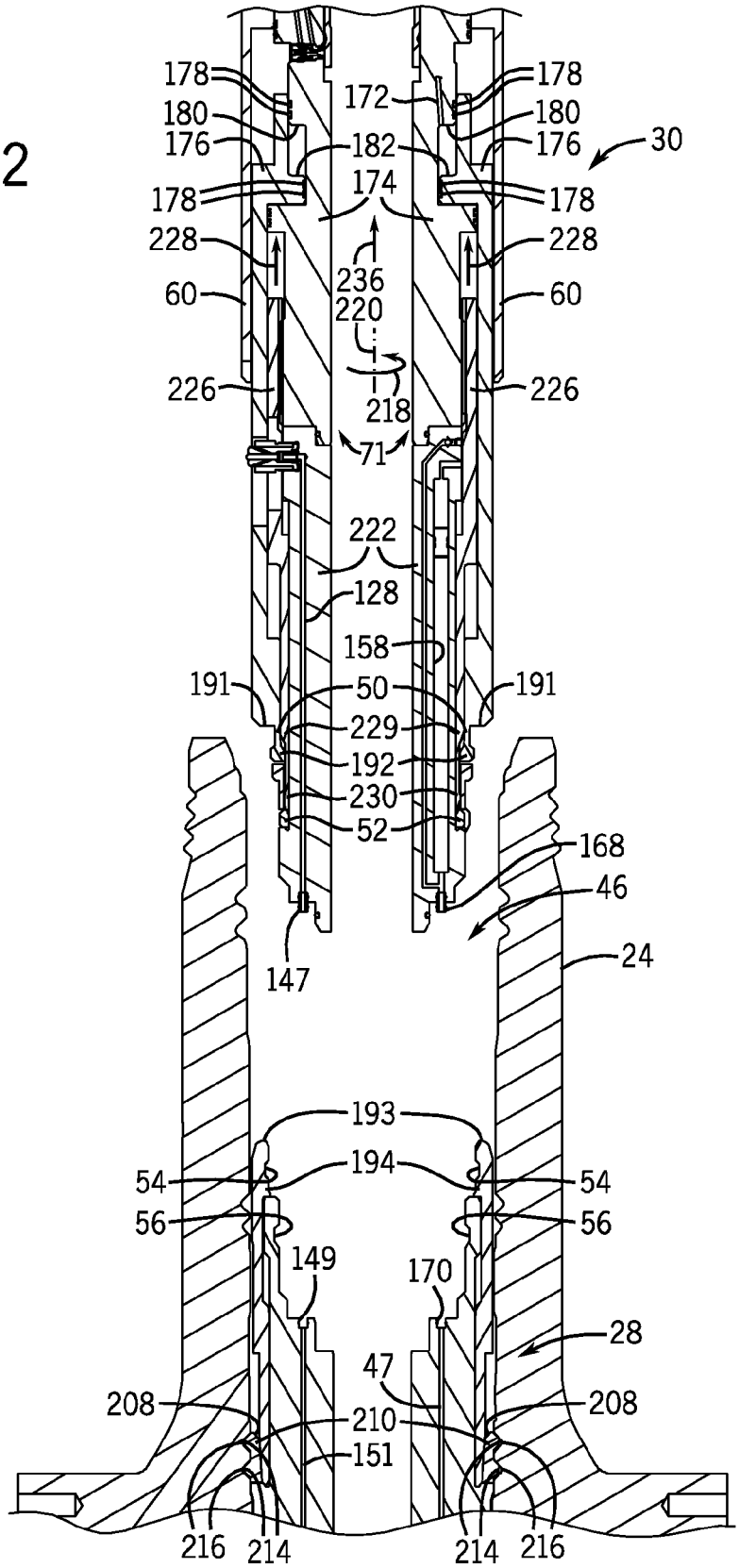
FIG. 12 is a cross-sectional view of the tubing hanger running tool and tubing hanger, in which the tubing hanger running tool is separated from the tubing hanger, in accordance with certain embodiments of the present technique.

FIG. 12 is a cross-sectional view of the THRT 30 and tubing hanger 28, in which the THRT 30 is separated from the tubing hanger 28. As illustrated, the connectors 147 and 149 which couple the THRT fluid conduit 128 to the tubing hanger fluid conduit 151 have been disengaged, thereby separating the valve 44 from the SSV 45. In addition, the connectors 168 and 170 which couple the pressure equalization tube 158 to the tubing hanger control line 47 have been disengaged, thereby separating the pressure equalization system 46 from a chemical injection line or valve control line, for example. Once the THRT 30 is extracted from the wellhead 12, maintenance operations, such as valve maintenance, may be performed on various components of the THRT 30 before the THRT 30 is reused for running operations. Consequently, the operational life of components such as the pressure release valve 44 may be enhanced compared to configurations in which similar components are integrated within the permanently mounted tubing hanger 28. In addition, because the present THRT 30 is capable of locking the tubing hanger 28 to the tubing spool 24, unlatching the THRT 30 from the tubing hanger 28, holding the SSV 45 in the open position during running operations, equalizing the pressure to the control lines, and gradually lowing the tubing hanger 28 into the landed position without the use of independent hydraulic lines, the present embodiments may obviate the umbilical line utilized in other THRT configurations. Consequently, the duration and costs associated with running operations may be significantly reduced.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a running tool configured to position a first component within a mineral extraction system, wherein the running tool comprises a first pressure equalization system, comprising:

a first fluid line configured to flow a first fluid;

a first piston disposed along the first fluid line; and a first fluid line connector coupled to the first fluid line, wherein the first piston is configured to equalize pressure between the first fluid and a surrounding fluid during running of the first component via the running tool, wherein bottom of the first piston is configured to contact the first fluid and top of the first piston is configured to contact the surrounding fluid, wherein the running tool is configured to be at least partially surrounded by the surrounding fluid.

2. The system of claim 1, wherein the first fluid line comprises a control line.

3. The system of claim 2, wherein the first control line comprises a hydraulic line.

4. The system of claim 2, wherein the first control line comprises a chemical injection line.

5. The system of claim 1, wherein the first fluid line connector comprises a stab connector.

6. The system of claim 1, wherein the running tool comprises a central bore and an annular wall extending around the central bore, wherein the first fluid line extends through the annular wall, and wherein the first piston is disposed along the first fluid line in the annular wall.

7. The system of claim 1, wherein the first fluid line connector is configured to couple with a second fluid line connector in an axial direction.

8. The system of claim 1, wherein the running tool comprises a gas reduction system coupled to the first fluid line.

9. The system of claim 8, wherein the gas reduction system comprises a gas reduction line coupled to the first fluid line, a check valve coupled to the gas reduction line, and a port coupled to the gas reduction line.

10. The system of claim 1, wherein the first component comprises a second fluid line connector coupled to a second fluid line, wherein the first and second fluid line connectors are configured to couple together during running of the first component via the running tool, and wherein the second fluid line is configured to house a second fluid.

11. The system of claim 10, wherein the first component comprises a hanger.

12. The system of claim 10, comprising a second component of the mineral extraction system, wherein the running tool is configured to run the first component into the mineral extraction system to couple with the second component, wherein the second component comprises a second pressure equalization system having a second piston disposed along a third fluid line.

13. The system of claim 12, wherein the first and second components are configured to couple together the second and third fluid lines via third and fourth fluid line connectors.

14. The system of claim 13, wherein the third and fourth fluid line connectors comprises mating stab connectors.

15. The system of claim 1, wherein the first fluid comprises a control fluid, and the surrounding fluid comprises a completion fluid.

16. A system comprising:

a tool configured to interact with a mineral extraction system, wherein the tool comprises a pressure equalization system, comprising:

a fluid line configured to flow a fluid;

a piston disposed along the fluid line; and a first fluid line connector coupled to the fluid line, wherein the piston is configured to equalize pressure between the fluid and a surrounding fluid during running of the tool into the mineral extraction system, wherein bottom of the piston is configured to contact the fluid and top of the piston is configured to contact the surrounding fluid, wherein the tool is configured to be at least partially surrounded by the surrounding fluid.

17. The system of claim 16, wherein the fluid line comprises a control line.

18. The system of claim 16, wherein the first fluid line connector is configured to couple with a second fluid line connector in an axial direction.

19. A system comprising:

a component; a running tool configured to position the component within a mineral extraction system; at least one fluid line extending through the component and the running too, wherein the at least one fluid line is configured to flow a fluid; and a pressure equalization system, comprising:

a piston disposed along the at least one fluid line; and a first fluid line connector coupled to the at least one fluid line, wherein the piston is configured to equalize pressure between the fluid and a surrounding fluid during running of the component via the running tool, wherein bottom of the piston is configured to contact the fluid and top of the piston is configured to contact the surrounding fluid, wherein the running tool is configured to be at least partially surrounded by the surrounding fluid.

20. The system of claim 19, wherein the first fluid line connector is configured to couple with a second fluid line connector in an axial direction, wherein the first fluid line connector is coupled to the component or the running tool.

* * * * *